US010724547B2

(12) United States Patent
Zoppas et al.

(10) Patent No.: US 10,724,547 B2
(45) **Date of Patent: *Jul. 28, 2020**

(54) CENTRIFUGAL PUMP COVER

(71) Applicant: I.R.C.A. S.P.A. Industria Resistenze Corazzate E Affini, San Vendemiano (IT)

(72) Inventors: Federico Zoppas, Treviso (IT); Maurizio Biasi, Fontanelle (IT); Damiano Montagner, Codogne (IT); Stefano Zanella, Montebelluna (IT)

(73) Assignee: I.R.C.A. S.P.A. INDUSTRIA RESISTENZE CORAZZATE E AFFINI, San Vendemiano (IT)

( * ) Notice: Subject to any disclaimer, the term of this patent is extended or adjusted under 35 U.S.C. 154(b) by 0 days.

This patent is subject to a terminal disclaimer.

(21) Appl. No.: 16/320,973

(22) PCT Filed: Jul. 27, 2017

(86) PCT No.: PCT/IB2017/054568

§ 371 (c)(1),
(2) Date: Jan. 25, 2019

(87) PCT Pub. No.: WO2018/020457

PCT Pub. Date: Feb. 1, 2018

(65) Prior Publication Data

US 2019/0162204 A1 May 30, 2019

(30) Foreign Application Priority Data

Jul. 27, 2016 (IT) ..... 102016000078782

(51) Int. Cl.
*F24H 1/10* (2006.01)
*H05B 1/02* (2006.01)
(Continued)

(52) U.S. Cl.
CPC ..... *F04D 29/588* (2013.01); *A47L 15/4225* (2013.01); *A47L 15/4285* (2013.01);
(Continued)

(58) Field of Classification Search
CPC ..... G06K 9/0061; G06K 9/00597; G06K 9/00604; G06K 9/00617; G06K 9/036;
(Continued)

(56) References Cited

U.S. PATENT DOCUMENTS 3,715,567 A * 2/1973 Mandziak ..... A47J 27/21108 219/437
5,257,341 A * 10/1993 Austin, Jr. ..... A61C 1/0069 392/487

(Continued)

FOREIGN PATENT DOCUMENTS

CN 202195572 4/2012
CN 105465050 4/2016

(Continued)

*Primary Examiner* — Sang Y Paik
(74) *Attorney, Agent, or Firm* — Stetina Brunda Garred & Brucker

(57) ABSTRACT

A cover (1) for a centrifugal pump which comprises a heating element (8), which has a heating stretch (10) and two end stretches (12) connected to the heating stretch (10), wherein the heating element (8) crosses the cover (1) so that the heating stretch (10) is under the cover (1) and the two end stretches (12) are over the cover (1), wherein at least one safety device (20), sensitive to the temperature of the electric resistor (8), fixed to the outer face (6), is provided and at least one control device (22), sensitive to both the temperature of the liquid and the temperature of the electric resistor (8), fixed to the outer face (6), is provided, wherein at least one first portion (14) of the heating stretch (10) is in contact with the cover (1), so that the heating stretch (10) is adapted to be contact with the liquid.

20 Claims, 5 Drawing Sheets

(51) Int. Cl.

| | |
|---|---|
| ***F04D 29/58*** | (2006.01) |
| ***A47L 15/42*** | (2006.01) |
| ***D06F 39/04*** | (2006.01) |
| ***F04D 15/00*** | (2006.01) |
| ***D06F 39/08*** | (2006.01) |

(52) U.S. Cl.
CPC ..... *D06F 39/04* (2013.01); *D06F 39/085* (2013.01); *F04D 15/0077* (2013.01); *A47L 15/4287* (2013.01); *D06F 39/083* (2013.01)

(58) Field of Classification Search
CPC .. G06K 9/00261; G06K 9/00885; G06K 7/10; G06K 7/10722; G06K 9/00221; G06K 9/00255; G06K 9/00281; G06K 9/00973; G06K 9/03; G06K 9/4633; G06K 9/52; G06K 9/6201; G06K 9/6282; G02B 7/36; G02B 7/28; H04N 5/23212; H04N 5/217; H04N 5/23219; H04N 5/23229; H04N 5/23232; H04N 5/23245; H04N 5/23248; H04N 5/23254; H04N 5/23267; H04N 5/23277; H04N 5/2353; A01K 11/00; A01K 11/006; G03B 13/36; G06F 16/22; G06F 16/90344; G06F 3/04886; G06Q 20/3674; G06Q 20/4014; G06T 2207/20201; G06T 5/003; G06T 7/20; G07C 9/00087; G07F 19/207; G07F 7/10
USPC ..... 392/473–794
See application file for complete search history.

(56) References Cited

U.S. PATENT DOCUMENTS

| | | | | |
|---|---|---|---|---|
| 5,724,478 | A * | 3/1998 | Thweatt | F24H 1/142 219/535 |
| 5,978,550 | A * | 11/1999 | Rochelle | F24H 9/1818 392/497 |
| 2001/0033743 | A1* | 10/2001 | Kishita | F24H 9/2071 392/485 |
| 2002/0136544 | A1* | 9/2002 | Rochelle | F24H 1/0081 392/485 |
| 2004/0173249 | A1 | 9/2004 | Assmann et al. | |
| 2007/0137599 | A1* | 6/2007 | Preiholt | F02H 19/10 123/142.5 E |
| 2008/0044168 | A1* | 2/2008 | Eichholz | D06F 39/04 392/471 |
| 2009/0047008 | A1* | 2/2009 | Straley | A01K 63/065 392/498 |
| 2016/0040686 | A1 | 2/2016 | Li et al. | |

FOREIGN PATENT DOCUMENTS

| | | |
|---|---|---|
| EP | 2960594 | 12/2015 |
| EP | 2960595 | 12/2015 |
| WO | 2015107510 | 7/2015 |

* cited by examiner

Fig. 5
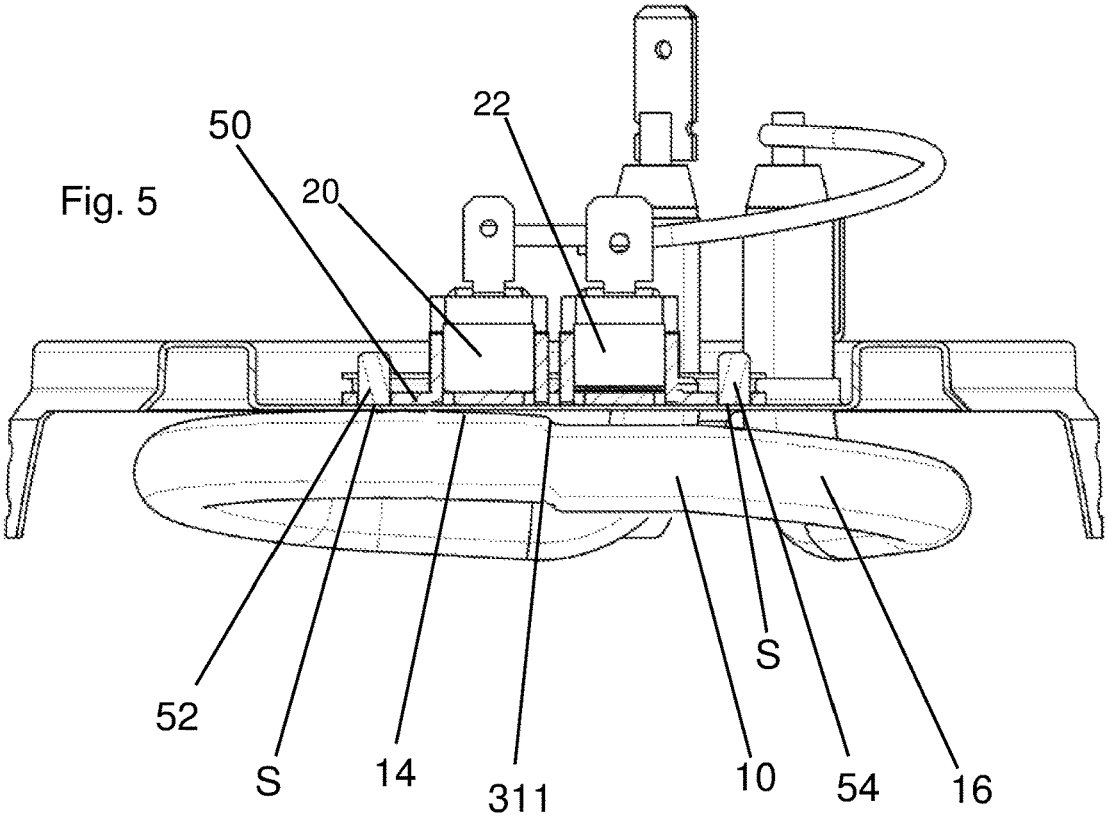
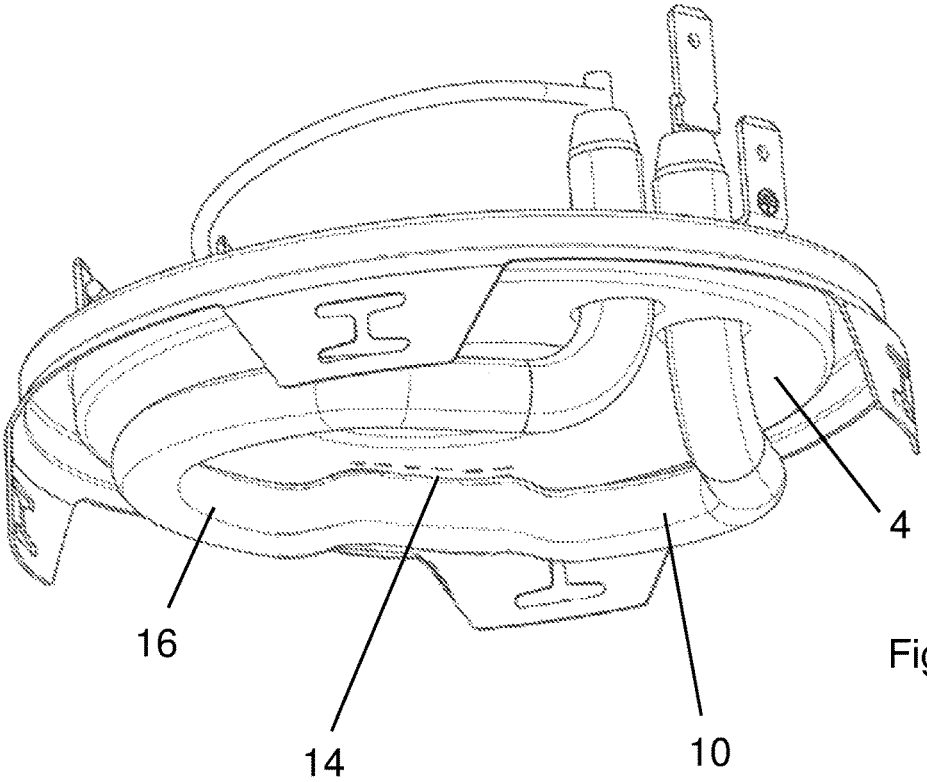
Fig. 6

CENTRIFUGAL PUMP COVER

CROSS REFERENCE TO RELATED APPLICATION(S)

The present application claims priority to PCT International Application No. PCT/IB2017/054568 filed on Jul. 27, 2017, which application claims priority to Italian Patent Application Nos. 102016000078782 filed Jul. 27, 2016, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a heater for household appliances, in particular to a cover equipped with heating element which may be used for a centrifugal pump.

PRIOR ART

In many household appliance applications, heaters are used to take the fluid, typically water, to the required working temperature.

In general, the heaters are coupled to recirculation pumps of the household appliances, e.g. to centrifugal pumps for dishwashers.

One type of heater has a metal cover to which a resistor, which generates the heat needed to heat the water, is coupled. The metal cover closes a chamber in which the water flows and the resistor is in contact exclusively with the outer face of the cover. When the resistor heats up, the cover also heats up and transmits the heat to the water in contact with its inner face. Consequently, in heaters of this type, the resistor is not in direct contact with the water to be heated because the cover is interposed between resistor and water. An example of heaters of this type is disclosed in document WO2015107510.

In general, the metal cover is provided with a control device and with a safety device to manage faulty or undesired operating conditions. For example, a thermostat and a thermal fuse may be coupled to the cover. The thermostat is used to manage the water temperature, while the thermal fuse is used to manage the faulty operating conditions of the resistor. Although very widespread, this type of heater has some limits.

In general, one of the greatest problems of the heaters for pumps is found in the dry operation management, i.e. when water does not circulate in the pump. In this case, the resistor should not be powered by electric current. The safety device, e.g. a thermal fuse, has the task of intervening if the resistor is heated in dry conditions. However, the consequence are catastrophic in case of failure of the safety device. The pump is damaged beyond repair in the best case.

So the need is felt to overcome the disadvantages of the known heaters.

SUMMARY OF THE INVENTION

It is an object of the present invention to provide a cover provided with heater for a pump of a household appliance, e.g. a dishwasher, which allows a better control on the heating of the heater.

It is another object of the present invention to provide such a cover provided with heater which is also more energy-efficient than the prior art.

It is a further object of the present invention to provide a cover which is reliable and easy to make at competitive costs.

The invention achieves at least one of such objects and other objects which will be apparent in light of the present description by means of a cover for a centrifugal pump for a liquid of a household appliance, which comprises a wall having an inner face intended to come into contact with the liquid and an outer face, opposite to the inner face, an electric resistor for heating the liquid, fixed to the cover and having a heating stretch, and two end stretches connected to the heating stretch, at least one safety device sensitive to the temperature of the electric resistor, fixed to the outer face; and at least one control device sensitive both to the temperature of the liquid and to the temperature of the electric resistor, fixed to the outer face;

wherein the electric resistor crosses the cover so that the heating stretch is arranged on the side of the inner face, whereby the heating stretch is adapted to be in contact with the liquid, and so that the two end stretches project from the side of the outer face, wherein a first portion of the heating stretch is in contact with the inner face and wherein at least one second portion of the heating stretch is distanced from the inner face.

According to the invention, the control device, e.g. a thermostat, is arranged so as to be sensitive to the resistor temperature in addition to the water temperature.

Advantageously, in this manner, in the case of faults of the safety device, e.g. a thermal fuse, the control device will intervene to avoid damage.

Furthermore, according to the invention, the heating stretch of the resistor can thus be directly in contact with the liquid. In this manner, the heating of the latter is optimized with respect to the prior art.

Advantageously, the invention allows an excellent heat exchange between the electric resistor and the water to be heated, but also allows a high sensitivity of the safety device and of the control device.

More in particular, the heat exchange between heating stretch and fluid, i.e. the water, is optimized because, since there is provided at least one portion of the heating stretch distanced from the cover, substantially the entire surface of such distanced portion can be lapped by the fluid, and therefore can exchange heat with the fluid. At the same time, since there is provided at least one portion in contact with the cover, a safety device, e.g. a thermal fuse, can be fixed to the cover either at or near such contact portion, so that such device is particularly sensitive to the temperature of the heating stretch.

Furthermore, a control device, e.g. a thermostat, can be fitted on the cover either at or near the portion of heating stretch which is distanced from the cover, so that the thermostat is particularly sensitive to the temperature of the fluid underneath.

Advantageously, the invention makes it possible to obtain an excellent reliability of the resistor and a low accumulation of lime scale.

In particular, the solution of the invention makes it possible to prevent dirt and/or lime scale from becoming blocked between resistor and wall of the cover, and thus makes it possible to obtain a generally very reliable resistor.

Further advantages of the invention are to being able to:

accurately control the water temperature without influencing the resistor temperature, despite the extreme compactness of the heater, in particular by virtue of the fact that the thin layer of fluid, e.g. water, present between resistor and thermostat is sufficient to allow to control the fluid temperature;

use less performing, and consequently more cost-effective, thermostats, in particular for the antiboiling function;

fit other types of sensor, e.g. sensors of the NTC type, in order to control the water temperature.

Preferably, the cover of the invention comprises a single electric resistor, in particular a single armored (sheathed) electric resistor. One or more resistor elements are provided in the armored electric resistors, e.g. one or more resistive wires.

According to an aspect, a centrifugal pump or recirculation pump is also provided, in particular for household appliances, comprising a body or a cover of the invention, wherein the cover is constrained to the body.

The electric resistor, which is an electric heater, is preferably an armored resistor, and for the purposes of description may also be named simply resistor.

The dependent claims describe preferred embodiments of the invention.

BRIEF DESCRIPTION OF THE FIGURES

Further features and advantages of the present invention will be more apparent in light of the detailed description of preferred, but not exclusive, embodiments of a centrifugal pump cover according to the present invention illustrated by the way of non-limitative example with reference to the accompanying drawings, in which:

FIG. 5 shows a section view of a variant of the cover of the invention;

FIG. 6 shows an axonometric bottom view of another variant of the cover of the invention;

The same references in the figure identify equal or substantially similar elements and components.

DETAILED DESCRIPTION OF EMBODIMENTS OF THE INVENTION

Figure 1:
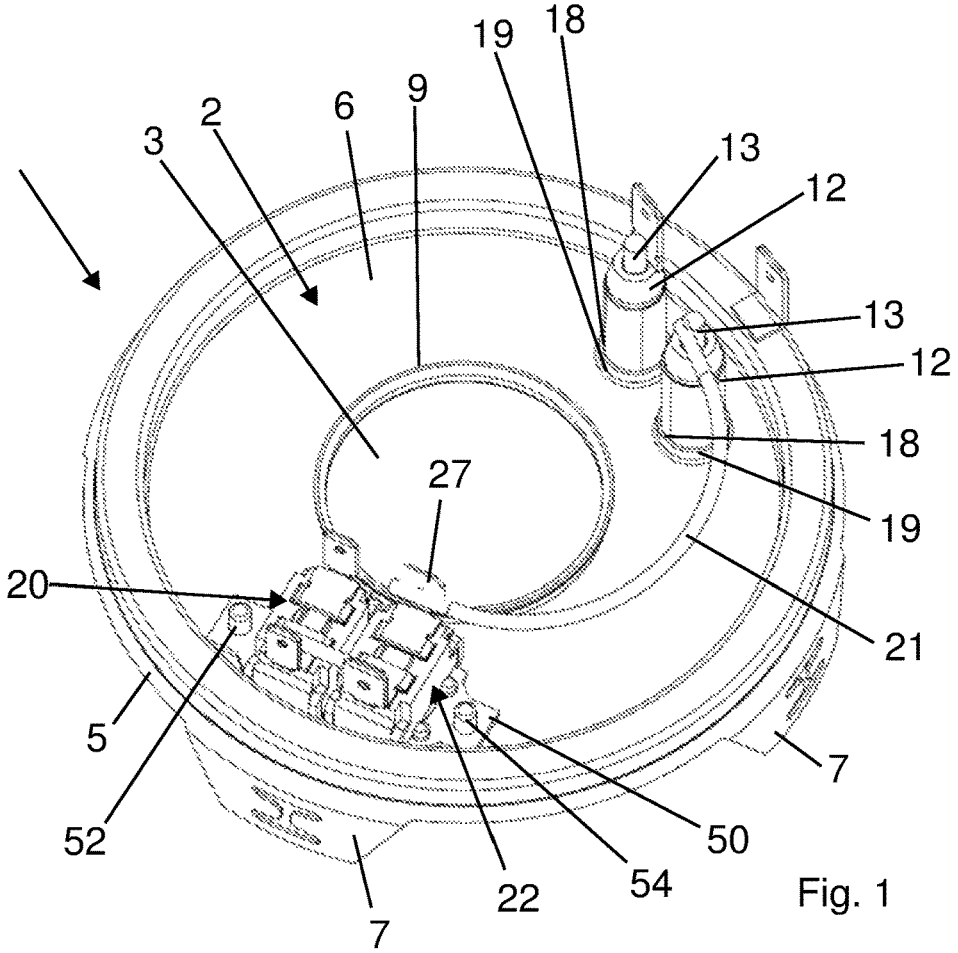
FIG. 1 shows an axonometric top view of a centrifugal pump cover according to the invention.
Figure 2:
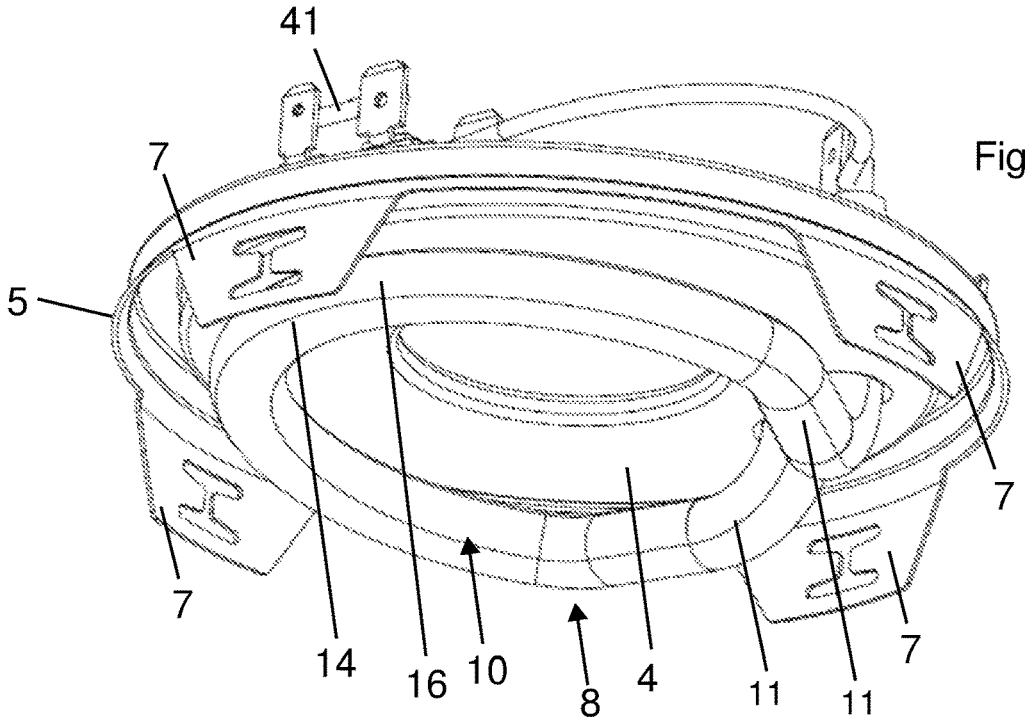
FIG. 2 shows an axonometric bottom view of the cover of FIG. 1.

With reference to the Figures, a cover 1 for a pump 101 (FIG. 9) is described, in particular for a centrifugal pump or a recirculation pump. Indeed, the cover 1 is configured to be fixed to a body 102 of the pump 101, e.g. a body which laterally delimits a pumping chamber 104 for a liquid. Once fixed to the body 102, the cover 1 also delimits the pumping chamber 104, acting as closure element. In particular, it is a cover of a pump used in household appliances, such as a dishwasher or a washing machine. Typically, this type of pump works with water.

The cover 1 is generally circular in shape, although other shapes are possible.

The cover 1 comprises a wall 2, which has an inner face, or lower face 4, and an outer face, or upper face 6.

The lower face 4 is destined to be in contact with the liquid when the cover 1 is fixed to the body 102 of the pump 101. In other words, the lower face 4 is an inner face of the pump 101. The upper face 6 is opposite to the lower face 4, and is an outer face of the pump 101, i.e. not destined to come into contact with the liquid.

Figure 9:
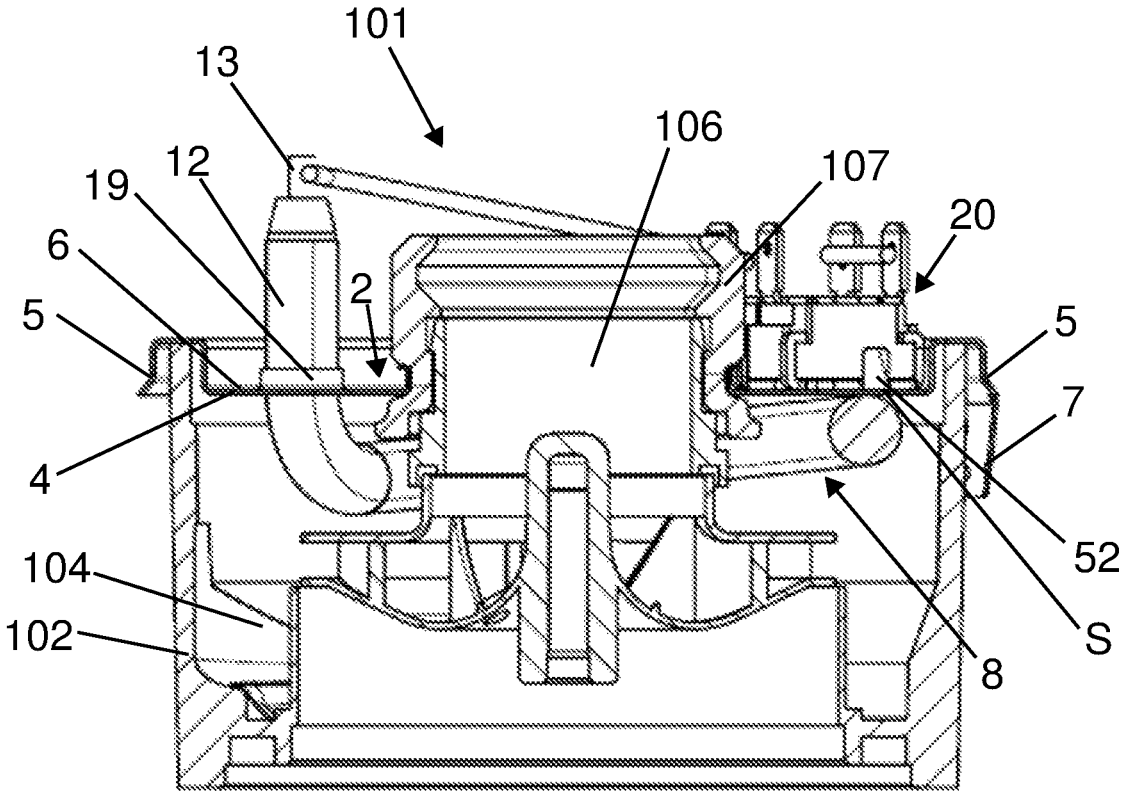
FIG. 9 shows a section view of a pump according to the invention.

A circular opening 3 is provided in the center of the cover 1 crossed by a pipe 106 of the pump 101, e.g. an inlet pipe of the liquid, when the cover 1 is fixed to the body 102. The upper face 6 comprises a shoulder 9 which extends outwards at the circular contour of the opening 3. The pipe 106 is fluid-tightly fixed to the shoulder 9, e.g. by means of one or more connection elements 107 (FIG. 9).

A skirt 5 extends from the contour of the wall 2 downwards. A plurality of wings 7, e.g. four wings, radially distanced from one another, extend downwards from the skirt 5. The wings 7 are used to fix the cover 1 to the body 102 or to another element of the pump 101. The cover 1 comprises a heating element which is typically a tubular electric resistor, in particular an armored resistor 8. The armored resistors are well known by a person skilled in the art and typically comprise a metal casing, e.g. made of stainless steel, in which at least one resistor element is provided. Preferably, but not exclusively, the outer surface of the casing, which is the outermost part of the armored resistor 8, has a circular section. The armored resistor 8, also said "resistor" for the purposes of description, comprises a heating stretch 10 and two end stretches 12 connected to the heating stretch 10. Each end stretch 12 is connected to the heating stretch 10 by means of a connecting stretch 11, preferably having a curvilinear axis. In other words, the heating stretch 10 extends between the two end stretches 12, in particular between the two connecting stretches 11.

Each end stretch 12 comprises a pin 13. Typically, one of the pins 13 is electrically connected to a control device 22.

The resistor 8 is used to heat the liquid which circulates in the pump 101. Indeed, the heating stretch 10 heats up when current is made to cross the resistor 8. Generally, the end stretches 12 are at a lower temperature than the heating stretch 10. Preferably, but not exclusively, a single armored resistor 8 is provided. Preferably, but not exclusively, the heating of the liquid occurs exclusively by means of the resistor 8.

The resistor 8 crosses the cover 1, in particular the wall 2, and is fixed to it. In other words, the resistor 8 crosses the entire thickness of the wall 2 with its two end stretches 12. More in details, the arrangement of the resistor 8 with respect to the wall 2 is such that the end stretches 12 are arranged on a first side of the wall 2, and in particular protrude from the upper, or outer, side, which is the side which comprises the upper face 6. Instead, the heating stretch 10 and the connection stretches 11 are arranged at a second side of the wall 2, opposite to said first side, and in particular are arranged on the lower or inner side which is the side which comprises the lower face 4. In other words, the end stretches 12 are over the wall 2 and the heating stretch 10 and the connection stretches 11 are under the wall 2. So, when the cover 1 is constrained to the pump 101, the heating stretch 10 is inside the pump 101, in particular inside a space delimited by the body 102 of the pump 101, and thus immersed in the liquid during the operation of the pump 101.

In order for the resistor 8 to cross the cover 1, the wall 2 is provided with two holes 18, crossed by a respective end stretch 12. More in detail, the end stretches 12 are fluid-tightly fixed to the inner edge of the respective hole 18. The fixing occurs by means of closure means, preferably by welding or brazing. In order to facilitate such fixing, a shoulder 19 preferably extends outwards from the circular contour of each hole 18. The holes 18 are sealed by effect of the fluid-tight fixing. The solution guarantees that the liquid does not exit from the pumping chamber 104 in undesired manner.

Typically, the resistor 8, in particular its heating stretch 10, has at least one portion 14 in contact with the lower face 4 and at least one distanced portion 16, i.e. not in contact with the lower face 4. In particular, the portion 16 facing towards the inner face 4 is distanced from it, meaning that there is a void between the portion 16 and the inner face 4. Preferably, the portion 14 of heating stretch 10 which is in contact with the lower face 4 is substantially the portion which is further distanced from the end stretches 12, although the portion 14 may be arranged elsewhere.

For example, a single portion 14 in contact with the lower face 4 and a single portion 16 distanced from the lower face 4 are provided. However, without departing from the present invention, a plurality of portions in contact with the lower face may be provided, e.g. two, three or more portions in contact. Consequently, a plurality of portions distanced from the lower face, preferably alternating with the contact portions, may be provided.

The portion 14 is preferably fixed to the lower face 4 by welding or brazing, in the latter case using an appropriate heat conducting material. Preferably, when the portion 14 is brazed to the lower face, the brazing filler material, in contact with the resistor 8 and with the inner face 4, defines a brazing area. Advantageously, the resistor remains firmly fixed to the wall 2, even if the latter is subject to thermal expansions. Alternatively, still having one or more portions in contact with the lower face, the resistor may be fixed to the cover only by fixing the end stretches to the holes. In this case, the appropriate geometry of the heating stretch with respect to the end stretches may be easily determined.

The heating stretch 10 defines an axis X, preferably substantially curvilinear. Preferably, the length of the portion 16 along axis X is greater than the length of the portion 14 along axis X.

Preferably, but not exclusively, the length of the portion 14 along axis X is comprised between 1% and 50% of the overall length of the heating stretch 10 along axis X, the remaining part of the length being the length of the portion 16.

For example, the length of the portion 14 along axis X is comprised between 10% and 40%, or between 10% and 20% of the overall length of the heating stretch 10 along axis X, the remaining part of the length being the length of the portion 16.

Preferably, but not exclusively, the length along axis X of portion 14 is at least equal to 1 mm, preferably is comprised between 1 mm and 314 mm, or between 10 mm and 100 mm, or between 10 and 40 mm, or between 20 and 40 mm, or between 20 and 30 mm. For example, when the length of the heating stretch 10 is approximately 200 mm, the length of the portion 14 is comprised between 20 and 40 mm.

Preferably, the length of the heating stretch 10 along axis X is comprised between 90 and 314 mm. The length of the portion 14 is preferably shorter than the overall length of the heating stretch. Alternatively, all the heating stretch is in contact with the lower face.

Figure 4:
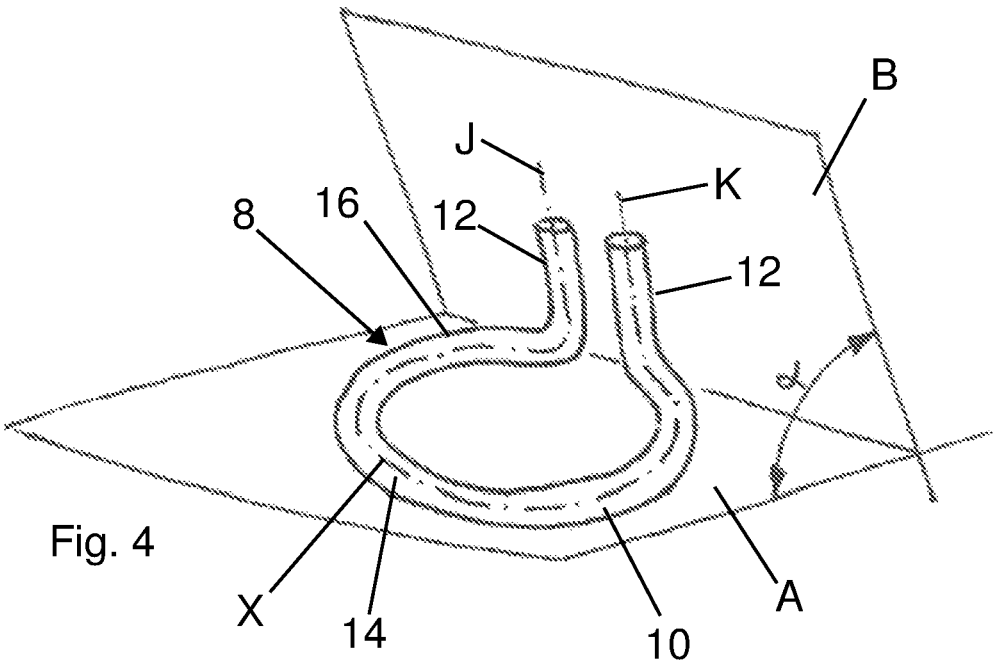
FIG. 4 shows a diagrammatic view of a component of the cover of the invention.

Preferably, the heating stretch 10 defines a curvilinear axis X (FIG. 4) which lies on a plane A. In particular, the heating stretch 10 substantially defines an arc of circumference. The end stretches 12 define a respective axis J, K. The two axes J, K, preferably rectilinear, lie substantially on a same plane B. The connection stretches 11 are curved and transversal to the curvilinear axis X. More in detail, the connection stretches 11 are transversal to the curvilinear axis X and to the plane A. Preferably, the connection stretches 11 define a respective curvilinear axis which at a first end coincides with the axis J, K of the corresponding end stretch 12; while a second end coincides with the curvilinear axis X of the heating stretch 10.

Preferably, but not exclusively the connection stretches 11 are not an active stretch. Thus, the heating stretch 10, or active stretch, is arranged between the connections stretches 11.

Preferably, but not exclusively, the plane A and the plane B mutually form an angle $\alpha$ smaller than 90°, e.g. comprised between 30° and 90° or for example comprised between 70° and 85°.

In the embodiment described above, the axes J and K are substantially parallel to each other, although they may be alternatively askew.

The cover 1 comprises at least one safety device 20 sensitive to the temperature of the resistor 8, fixed to the outer face 6, and at least one control device 22 sensitive to the both the liquid temperature and the temperature of the resistor 8, fixed to the outer face 6.

In particular, the safety device(s) are preferably of the "one shot" type, i.e. which cannot be reset or recharged. Typically, but not exclusively, a safety device of this type determines an opening of the electric circuit, e.g. of the power circuit of the resistor, by means of a fuse or by means of a bi-metallic element.

A safety device is preferably a thermal fuse 20.

Furthermore, the control device(s) are preferably of the self-resetting type. A control device is preferably a thermostat 22, in particular of the self-resetting type.

For example, there are provided only one thermal fuse 20 and only one thermostat 22.

The thermal fuse 20 is fixed to the upper face 6, and in particular is in contact or in any case in thermal contact with it. The thermal fuse 20 is fixed in a zone of the upper face 6 either near or substantially at the zone of the lower face 4 in contact with the portion 14 of the heating stretch 10. In particular, the thermal fuse 20 can be fixed in a zone of the upper face 6 corresponding to the zone of the lower face 4 in contact with the portion 14 of the heating stretch 10, or more simply corresponding to the portion 14.

Alternatively, if the thermal fuse 20 is near the portion 14, the thermal fuse 20 is preferably within a radius comprised between 0.1 and 100 mm, e.g. comprised between 0.1 and 50 mm, even more preferably between 10 and 20 mm, from portion 14. Such radius is preferably defined considering as center the center of gravity of the zone of the upper face 6 over the portion 14 or of the brazing area between resistor 8 and lower face 4. For example, considering as center the center of gravity of the zone of the upper face 6 over the portion 14, the thermal fuse 20 is arranged within a radius of 25 mm. The thermal fuse 20 is electrically connected, preferably in series, to the thermostat 22, e.g. by means of an electric connector 41 connected to a respective wing 27 of the thermostat 22 and of the thermal fuse 20. Furthermore, the thermal fuse 20, or safety device, is configured to be connected to an electric power source (not shown). Advantageously, the thermal fuse 20 is in thermal contact with the resistor 8. In particular, considering its arrangement, the thermal fuse 20 is very sensitive to the temperature variations of the resistor 8, and can readily intervene in case of faulty or undesired operating conditions. For example, the thermal fuse 20 may intervene in dry operating conditions, i.e. without circulating fluid, which determines an undesired and excessive increase of the temperature of the resistor. The thermal fuse 20 intervenes interrupting the power supply to the resistor 8 when the latter reaches a predetermined temperature. Note that the resistor 8 may also incorporate another thermal fuse inside it (not shown). A double control is possible in this case.

The thermostat 22 is also fixed and in contact with the upper face 6, or in all cases in thermal contact with it. Preferably, the thermostat 22 is arranged in a zone of the upper face 6 under which the lower face 4 can come directly into contact with the liquid. Thus the thermostat 22 is at the portion 16 of the heating stretch 10. In other words, it is a different zone from the one where the thermal fuse 20 is positioned. In this manner, the thermostat 22 is sensitive to the liquid temperature variations, and can manage the temperature of the resistor 8 according to the temperature of the liquid. The position of thermostat 22 makes it possible to adjust the temperature of the liquid. Furthermore, according to the invention, the thermostat 22 is also sensitive to the temperature of the resistor 8. Indeed, according to the invention, the thermostat 22 is close enough to the resistor 8 to be sensitive to its temperature. The thermostat 22 is electrically connected to the resistor 8, e.g. by means of an electric connector 21 connected to an end stretch 12, in particular to a pin 13. Furthermore, the thermostat 22 or safety device is configured to be connected to the electric power source. Preferably, the thermostat 22 is provided with a wing 27 adapted to be electrically connected to the power source by means of the electric connector 21, and to the thermal fuse 20 by means of a connector 41.

The thermostat 22 can have a control of the liquid temperature by operating on the resistor 8, e.g. on the electric power supplied to the resistor.

In general, the thermal fuse 20 and the thermostat 22 can be fixed to the upper face 6 in many ways by means of fixing means. According to an example, the fixing means are one or more springs (not shown). According to another example, the thermal fuse 20 and the thermostat 22 are preferably fixed to the upper face 6 either by means of a same thermally conductive fixing means or element or by means of respective first and second thermally conductive fixing means or elements 52, 54, also known as thermal joints. The first fixing means 52 transfer the heat to the thermal fuse 20, and the second fixing means 54 transfer the heat to the thermostat 22. The thermally conductive fixing means 52, 54 each have a base which defines an area S (shown for example in FIGS. 3, 5 and 9). For at least one of the thermally conductive fixing means 52, 54, it is preferred that at least 0.1%, preferably between 10 and 100%, e.g. approximately 100%, of the base area S is at the portion 14 of the heating stretch or at the brazed area between the resistor 8 and the lower face 4. Both thermally conductive fixing means 52, 54 may have this configuration.

By way of example, the thermally conductive fixing means 52, 54 are one or more metal fixing pins or pegs. In this case, the pins are either welded or brazed to the upper face 6, it not being provided that they cross the wall 2. Alternatively, the thermally conductive fixing means are one or more threaded screws coupled to respective holes in the wall 2.

Figure 3:
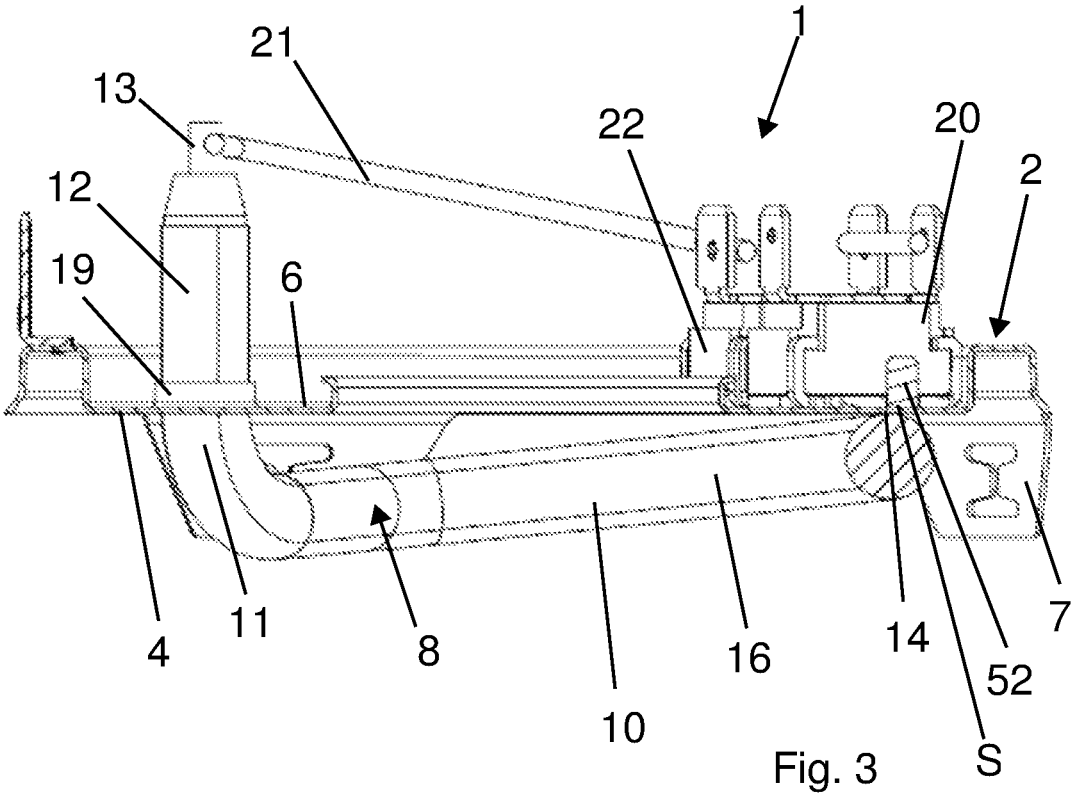
FIG. 3 shows a section view of the cover in FIG. 1.
Figure 7:
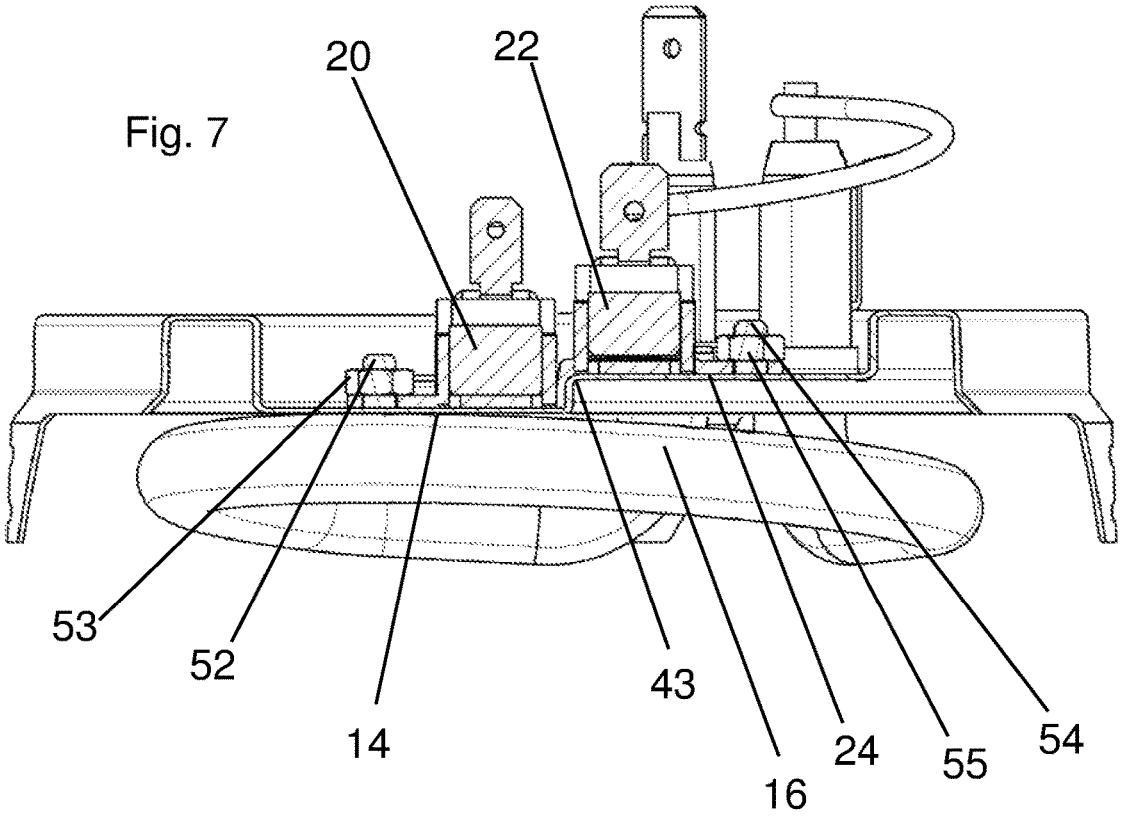
FIG. 7 shows a section view of another variant of the cover of the invention.
Figure 8:
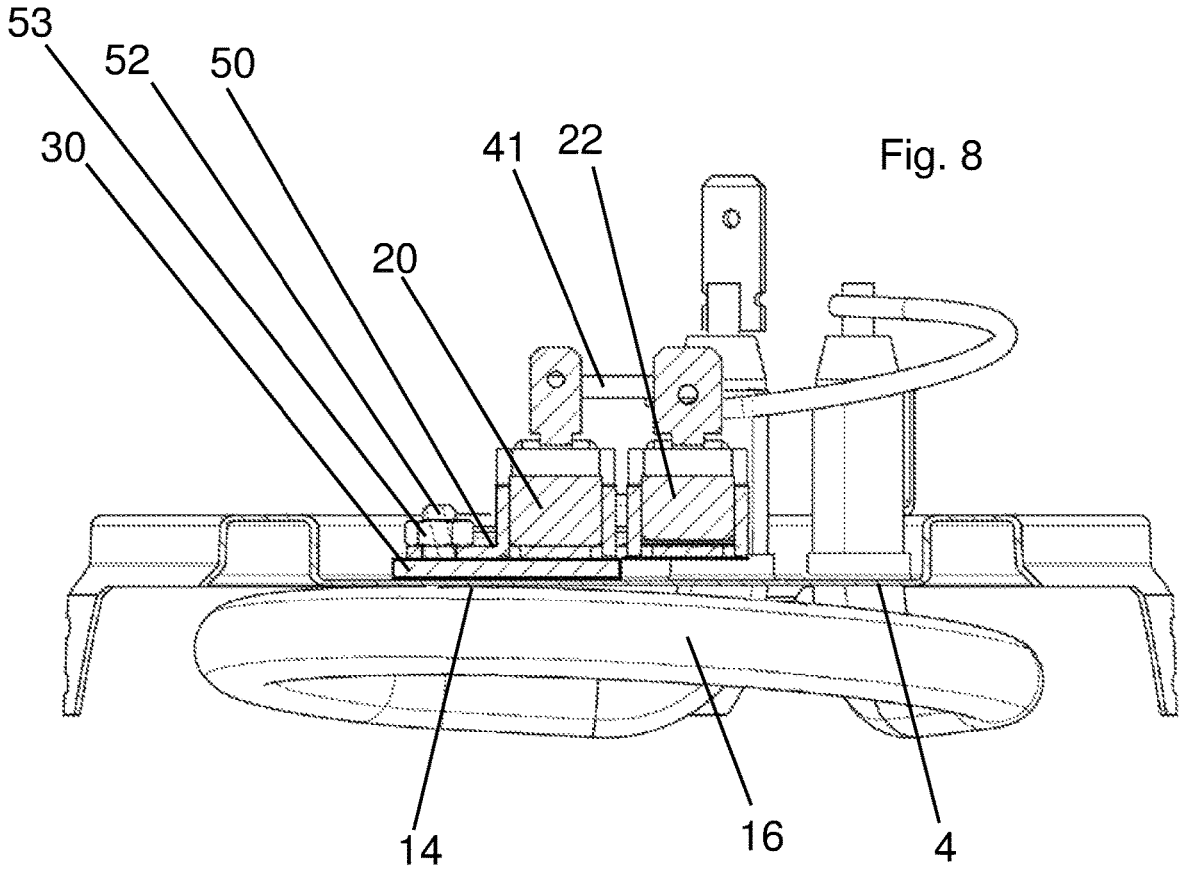
FIG. 8 shows a section view of another variant of the cover of the invention.

Preferably, but not exclusively, the thermal fuse 20 and the thermostat 22 are provided with a same thermally conductive attachment portion 50 to which the thermally conductive fixing means 52, 54 are fixed, e.g. by means of a respective nut 53, 55 (see for example FIGS. 7 and 8), or by means of welding or brazing (see for example FIGS. 3 and 5). Even more preferably, the thermal fuse 20 and the thermostat 22 belong to a same device or component.

Preferably, the first thermally conductive fixing means, e.g. the pin 52 of the thermal fuse 20 are arranged at the portion 14 of heating stretch 10 connected to the lower face 4. So, the pin 52 is also sensitive to the temperature of the resistor 8.

Furthermore, the second thermally conductive fixing means, e.g. the pin 54 of the thermostat 22 are arranged (i) at the portion 16 of the heating stretch 10 distanced from the inner face 4 and (ii) near the portion 14 of heating stretch 10 connected to the lower face 4.

So, the pin 54 is sensitive to both the liquid temperature and the resistor temperature 8.

Preferably, the pin 54 of the thermostat 22 or the thermostat 22 itself are in a zone of the upper face 6 below which the distance between lower face 4 and electric resistor 8 is comprised between 0.1 to 50 mm, preferably between 0.5 and 20 mm.

Additionally or alternatively to the previous feature, the pin 54 of the thermostat 22, or the thermostat 22 itself, is preferably at a distance from the portion 14, or from the brazing area, comprised between 0.1 and 100 mm, preferably between 0.1 and 80 mm. The aforesaid distance is typically a minimum distance, considering the geometric definition of "distance".

Additionally or alternatively to the preceding features, the thermal fuse 20 and the thermostat 22 are preferably at a distance from each other comprised between 0.1 and 200 mm. Such distance is, for example, the minimum distance between the respective outermost portions of the thermal fuse 20 and of the thermostat 22.

Preferably, the distance between the pin 52 and the thermal fuse 20 is comprised between 0.1 and 50 mm; and/or the distance between the pin 54 and the thermostat 22 is comprised between 0.1 and 50 mm.

According to a variant (FIG. 5), the heating stretch 10 has a step 311, so that it has a greater distance between the lower face 4 and the heating stretch 10. In other words, there is sufficient distance between thermostat 22 and resistor 8, and in particular between thermostat 22 and brazed or welded area.

According to a further variant, shown in FIG. 6, the portion 14 of heating stretch 10 in contact with the lower face 4 is approximately 90° with respect to the end stretches 12. In this case, the portion 14 defines an axis which is offset with respect to the axis of the remaining portion of heating stretch 10. In general, the contact portion is preferably arranged considering the final orientation of the pump with respect to the household appliance on which it is fitted. In particular, the contact portion may be in the highest position with respect to the base of the household appliance.

According to another variant (FIG. 7), the lower face 4 is provided with a recess 24 to which corresponds an elevation of the upper face 6. In particular, the recess 24 is either adjacent to or near the portion 14 of heating stretch 10 connected to the lower face 4. More in detail, the step 43 of the lower face 4, which is formed because of such recess 24, is preferably in a radius comprised between 0.1 and 50 mm from the end of the portion 14. The thermostat 22 is in contact with the face 6 at such recess 24, i.e. which is arranged on the elevation. So the lower face 4, at the recess 24, is distanced from the portion 16 of the heating stretch 10, preferably at a distance comprised between 0.1 and 50 mm. An advantage of the recess 24 is appreciated during the step of manufacturing because it makes it possible to easily and accurately identify the zone of the lower face 4 where the welding or brazing should be made. Furthermore, there is sufficient distance between thermostat 22 and resistor 8, and in particular between thermostat 22 and brazed or welded area.

According to another variant (FIG. 8), there is a supporting element 30, e.g. a metal plate, under the thermal fuse 20. The plate 30 is in contact on one side with the upper face 6 and on the other side with the thermal fuse 20. The plate 30 is at least partially at the portion 14. The plate 30 is fixed to the upper face 6 by means of the pin 52. In this variant a single pin 52 is provided which transfers heat to both the thermal fuse 20 and the thermostat 22. Preferably, the length of the plate 30 along the upper face 6 is 50 mm at most. The thermal fuse 20 and the thermostat 22 form a single part or component. Under the thermostat 22 there is a void, so that it is substantially suspended.

By way of example only, the end stretches 12 of the resistor 8 can be inserted in the holes 18 from the bottom upwards, with reference to the illustrations of the Figure, to produce the cover 1. The end stretches are then welded or brazed to the inner edge of the respective hole and, if provided, a portion of the heating stretch is welded or brazed to the lower face 4.

After having provided a description of embodiments of the invention by way of example, the following clarifications are provided in order to prevent erroneous or limitative interpretations of the invention. In particular, it is apparent that the words upper, lower, downwards, upwards, outwards and the like are used exclusively for the purposes of description, in conventional manner, with reference to the accompanying Figures. Furthermore, if part of the description is made with reference to a "pin", this part may also apply to other thermally conductive fixing means.

The invention claimed is:

1. A cover for a centrifugal pump for a liquid of a household appliance, the cover comprising:

a wall having an inner face, intended to come into contact with the liquid, and an outer face, opposite to the inner face;

an electric resistor for heating the liquid, fixed to the cover and having a heating stretch and two end stretches connected to the heating stretch;

at least one safety device sensitive to the temperature of the electric resistor, fixed to the outer face; and at least one control device sensitive both to the temperature of the liquid and to the temperature of the electric resistor, fixed to the outer face, wherein, the electric resistor crosses the cover so that the heating stretch is arranged on the side of the inner face whereby the heating stretch is adapted to be in contact with the liquid, and so that the two end stretches project from the side of the outer face, wherein at least one first portion of the heating stretch is in contact with the inner face, wherein at least one second portion of the heating stretch is spaced apart from the inner face, wherein the at least one safety device is fixed to the outer face nearer than the at least one control device to the at least one first portion of the heating stretch that is in contact with the inner face, wherein the at least one control device is arranged in a zone of the outer face under which the inner face can come directly into contact with the liquid.

2. The cover according to claim 1, wherein said at least one first portion is welded to the inner face, thus defining a welding area, or is brazed to the inner face, thus defining a brazing area.

3. The cover according to claim 1, wherein the wall is provided with two holes delimited by a respective inner edge, and wherein the end stretches cross a respective hole and are fixed to a respective inner edge, so that the holes are fluid-tightly Sealed by means of closure means.

4. The cover according to claim 1, wherein the at least one control device is in a zone of the outer face below which the distance between the inner face and the electric resistor is comprised between 0.1 and 50 mm.

5. The cover according to claim 1, wherein said at least one control device is at a distance from the at least one first portion comprised between 0.1 and 100 mm; or wherein said at least one control device is at a distance from a brazing area where the at least one first portion is brazed to the inner face comprised between 0.1 and 100 mm.

6. The cover according to claim 1, wherein the at least one safety device and the at least one control device arc part of a single component.

7. The cover according to claim 1, wherein there is provided at least one fixing element which fixes the at least one safety device and/or the at least one control device to the outer face.

8. The cover according to claim 7, wherein said at least one fixing element is a thermally conductive element.

9. The cover according to claim 8, wherein the at least one thermally conductive element has a base fixed to the outer face, wherein said base has a surface S, and wherein at least 0.1% of said surface S is at the at least one first portion or wherein at least 0.1% of said surface S is at a brazing area where the at least one first portion is brazed to the inner face.

10. The cover according to claim 8, wherein the at least one thermally conductive fixing element is at a distance from the at least one first portion comprised between 0.1 and 100 mm, or wherein the at least one thermally conductive fixing element is at a distance from a brazing area where the at least one first portion is brazed to the inner face, comprised between 0.1 and 100 mm.

11. The cover according to claim 8, wherein the at least one thermally conductive fixing element is in a zone of the outer face below which the distance between inner face and electric resistor is comprised between 0.1 and 50 mm.

12. The cover according to claim 1, wherein the at least one safety device is fixed in a zone of the outer lace corresponding to the at least one first portion of the heating stretch.

13. The cover according to claim 1, wherein the at least one safety device is within a radius comprised between 0.1 and 100 mm front the center of a zone of the outer face corresponding to the at least one first portion of the heating stretch, preferably considering, as center, the center of gravity of the area of the outer face above the at least one first onion or above the center of gravity of a brazing area between the electric resistor and the inner face.

14. The cover according to claim 1, wherein the heating stretch defines a curvilinear axis X lying on a first plane A, and each end stretch of said two end stretches defines a respective axis J, K lying on a second plane B, and wherein the first plane A and the second plane B are inclined one with respect to the other by an angle $\alpha$ which is less than 90°.

15. The cover according to claim 1, wherein the inner face is provided with a recess at said second portion, and wherein said at least one control device is arranged at said recess.

16. The cover according to claim 1, comprising at least one further safety device, preferably at least one thermal fuse, which is accommodated inside the electric resistor.

17. The cover according to claim 1, wherein the heating stretch defines a substantially curvilinear axis X and the length of the at least one second portion along said curvilinear axis X is greater than the length of the at least one first portion.

18. The cover according to claim 17, wherein the length of the at least one first portion along said curvilinear axis X is comprised between 10% and 40% of the total length of the heating stretch.

19. The cover according to claim 1, wherein the at least one safety device comprises a thermal fuse and the at least one control device comprises a thermostat.

20. A centrifugal pump comprising a body and a cover according to claim 1, said cover being constrained to the body.

* * * * *